United States Patent [19]

Kanto et al.

[11] Patent Number: 4,933,315

[45] Date of Patent: Jun. 12, 1990

[54] HEAT TRANSFER SHEET

[75] Inventors: Jumpei Kanto, Komae; Hitoshi Saito, Chiba; Nobuhisa Nishitani, Tokyo; Masaki Kutsukake, Chofu; Tatsuya Kita, Tokyo; Masanori Akada, Tokyo; Masayuki Nakamura, Tokyo; Katsuhiro Kamakari, Tokyo, all of Japan

[73] Assignee: Dai Nippon Insatsu Kabushiki Kaisha, Japan

[21] Appl. No.: 156,606

[22] Filed: Feb. 17, 1988

[30] Foreign Application Priority Data

| | | | |
|---|---|---|---|
| Feb. 20, 1987 | [JP] | Japan | 62-35759 |
| Feb. 21, 1987 | [JP] | Japan | 62-38232 |
| Jul. 29, 1987 | [JP] | Japan | 62-187715 |
| Dec. 30, 1987 | [JP] | Japan | 62-335297 |

[51] Int. Cl.[5] ..... B41M 5/035; B41M 5/26

[52] U.S. Cl. ..... 503/227; 8/471; 428/195; 428/423.1; 428/913; 428/914

[58] Field of Search ..... 8/471; 428/195, 913, 428/914, 423.1; 503/227

[56] References Cited

U.S. PATENT DOCUMENTS

| | | | |
|---|---|---|---|
| 4,614,521 | 9/1986 | Niwa et al. | 8/471 |
| 4,737,486 | 4/1988 | Henzel | 503/227 |

FOREIGN PATENT DOCUMENTS

| | | | |
|---|---|---|---|
| 0153880 | 9/1985 | European Pat. Off. | 503/227 |
| 2161824A | 1/1986 | United Kingdom | 503/227 |

*Primary Examiner*—Bruce H. Hess

*Attorney, Agent, or Firm*—Arnold, White & Durkee

[57] ABSTRACT

A heat transfer sheet to be used for heat-sensitive transfer, comprising a substrate sheet and a dye layer formed on said substrate sheet, said dye layer being constituted of a layer containing a yellow dye, a cyan dye, and a magenta dye comprising a specific compound having phenylene-diamine or its derivative as the developer.

10 Claims, 4 Drawing Sheets

HEAT TRANSFER SHEET

BACKGROUND OF THE INVENTION

This invention relates to heat transfer sheets and more particularly is intended to provide a heat transfer sheet capable of easily producing a recorded image of excellent fastnesses onto a heat transferable material.

Various heat transfer methods have been known in the art, among which the sublimating transfer method has been and is being practiced. In this method a sublimating dye is used as the recording agent, which is carried on a substrate sheet such as paper, etc. to provide a heat transfer sheet, which is then superposed on a heat transferable material dyeable with a sublimating dye such as a fabric made of polyester, and heat energy is imparted in a pattern from the back surface of the heat transfer sheet to cause the sublimating dye to migrate to the heat transferable material.

In the case of this sublimating transfer method, in the sublimating printing method in which the heat transfer material is, for example, a fabric made of polyester, the heat transferable material itself is also heated by the heat energy imparted since heat energy is imparted for a relatively longer time, whereby relatively good migration of the dye can be accomplished.

However, with the progress of the recording method, by the use of, for example, a transferable material having a dye receiving layer provided on a polyester sheet or paper and by the use of a thermal head at high speed when fine letters or figures or photographic images are to be formed on these transferable materials, heat energy must be imparted within an extremely short time of the order of seconds or less, and the sublimatable dye and the transferable material cannot be heated sufficiently within such a short time, whereby an image with sufficient density cannot be formed.

Accordingly, in order to correspond to such high speed recording, sublimating dyes of excellent sublimatability have been developed. However, dyes of excellent sublimatability generally have smaller molecular weights, and therefore there arise problems such as migration of the dyes in the heat transferable material after transfer and bleeding of the dyes onto the surface, whereby the images formed with much effort may be distorted or become unclear or may contaminate surrounding articles.

When a sublimating dye with relatively greater molecular weight is used for avoiding such problems, an image with satisfactory density could not be formed because of inferior sublimation speed according to the high speed recording method as described above.

Accordingly, in the method of heat transfer by the use of the sublimating dye, there has been a great demand under the present situation for development of a heat transfer sheet which can produce a clear image with sufficient density and an image formed exhibiting various fastnesses.

We have carried out intensive studies in order to respond to the strong demand in the field of the art as described above. As a result, in the light of the art of the sublimating printing method of fabrics made of polyester, etc., in which due to non-smoothness of the surface of the fabric, the heat transfer sheet and the fabric which is the heat transferable sheet are not sufficiently contacted, and therefore the dye to be used is essentially required to be sublimatable or gasifiable (namely migratable through the space existing between the heat transfer sheet and the fabric), it has been found that in the case of using a polyester sheet or surface processed paper, etc., with smooth surface as the heat transferable material, the heat transfer sheet and the heat transferable material can sufficiently contact each other, whereby only the sublimatability or gasifiability of the dye is not an absolutely necessary condition, but the property of the dye migratable through heat between the closely contacted interface of both is also extremely important, and such heat migratability at the interface is greatly influenced by the chemical structure of the dye used, the substituent or its position. Thus, it has been found that even a dye with a high molecular weight as generally accepted in the prior art as unuseable has good heat migratability by selecting a dye having an appropriate molecular structure. And by the use of a heat transfer sheet having such a dye carried thereon, it has been found that the dye used can be caused to migrate easily to the heat transferable material to form a recorded image with high density and various excellent fastnesses.

SUMMARY OF THE INVENTION

The present invention has been achieved on the basis of the above-described findings. More specifically, the heat transfer sheet according to the present invention comprises a dye layer comprising a layer containing at least one of yellow dyes, cyan dyes and magenta dyes represented by the formulae as set forth hereinafter.

DESCRIPTION OF THE DRAWINGS

In the accompanying drawings:

FIGS. 3(*b*), 3(*c*) and 3(*d*) are a sectional views respectively showing examples of the heat transfer sheet of the present invention.

DETAILED DESCRIPTION OF THE INVENTION

Figure 1:
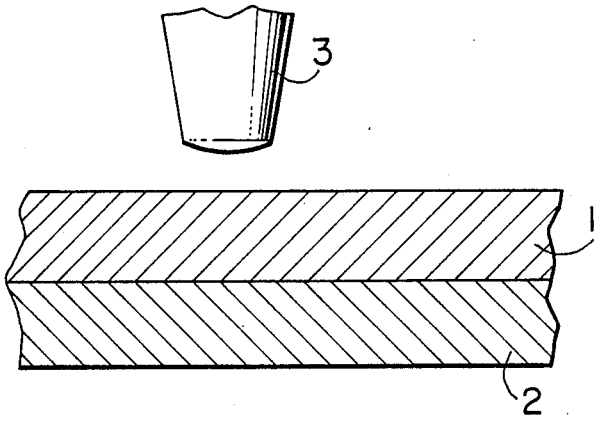
FIG. 1 is an enlarged fragmentary sectional view of the heat transfer sheet according to the present invention.

Yellow dyes, cyan dyes, and magenta dyes suitable for use in the present invention are as follows.

Yellow dyes

Dyes represented by the following formula (I)

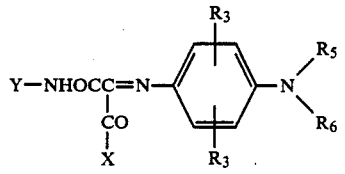

(I)

wherein: X is a phenyl group which may have a substituent or a $R_7$—$C(CH_3)_2$— group ($R_7$ represents an alkyl, alkoxy, aryloxy or thioalkyl group); Y is

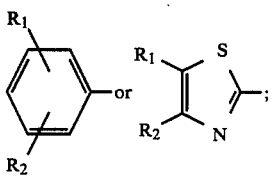

color forming property, color reproducibility and at the same time migration resistance after transfer, etc. and, further, excellent fastness, particularly storability and light resistance.

As for the molecular weight, a molecular weight of 310 or more, preferably 350 or more, more preferably 380 or more, is preferred.

Preferable specific examples of the above dye are as shown in Table 1.

TABLE 1

| Example | X | Y | $R_3$ | $R_4$ | $R_5$ | $R_6$ | Molecular Weight |
|---|---|---|---|---|---|---|---|
| 1-1 | $CH_3O$ | $NHCOCH_3$, Cl | $CH_3$ | H | $C_2H_5$ | $C_2H_4OH$ | 550.5 |
| 1-2 | $CH_3COC(CH_3)_2$ | | $CH_3$ | H | $C_2H_4OH$ | $C_2H_4OH$ | 439.0 |
| 1-3 | $CH_3COC(CH_3)_2$ | | $CH_3$ | H | $C_2H_5$ | $C_2H_4OH$ | 367 |
| 1-4 | $C_2H_5SC(CH_3)_2$ | | Cl | H | $C_2H_5$ | $C_2H_5$ | 431.6 |

$R_1$ through $R_4$ each represent a halogen atom, an alkyl, cycloalkyl, alkoxy, acylamino, aminocarbonyl, alkylaryl, cyano or aryl group; and $R_5$ and $R_6$ each represent a hydrogen atom, an alkyl group which may have also substituent, an aralkyl or aryl group.

Each of the dyes represented by the above formula (I) has excellent heating migratability, even if it may have a relatively larger molecular weight, and further exhibits excellent dyeability and color forming characteristic for transferable material. Moreover, no migratability of the dye (bleeding property) can be seen in the transferred transferable material. Thus, it has extremely ideal properties as a dye for a heat transfer sheet.

The dyes represented by the above formula are obtained from p-phenylenediamine type compounds and acylacetanilides according to the coupling method known in the art.

The dyes of the formula (I) which are preferable in the present invention are those wherein Y is a substituted phenyl, at least one of $R_1$ or $R_2$ is a group containing an unpaired electron existing at the 3- or 5-position and those wherein at least one of $R_3$ or $R_4$ is a group containing an unpaired electron existing at the 1-or 3-position, particularly preferably those among the above preferable dyes wherein $R_5$ and/or $R_6$ are/is $C_2$ to $C_6$ alkyl group, and at least one of $R_5$ and $R_6$ has a polar group such as a hydroxyl group or a substituted hydroxyl group, amino group, substituted amino group, cyano group, or the like, to give the best results, namely, excellent heat migratability, dyeability for heat transferable materials, heat resistance during transfer, Cyan dyes Dyes represented by the following formula (II) or (III):

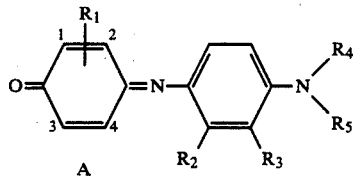

(II)

wherein: $R_1$ represents CONHR, CONRR', COOR, NHCOR, $SO_2NHR$, $NHSO_2R$ (R, R' each represent an alkyl group of which hydrogen atom may be substituted with fluorine atom, a cycloalkyl group or an aryl group which may also have substituent); $R_2$ and $R_3$ each represent a halogen atom, an alkyl, cycloalkyl, alkoxy acylamino aminocarbonyl, alkylaryl or aryl group; $R_4$ and $R_5$ each represent an alkyl group which may have also substituent, an aralkyl, aryl group or hydrogen atom; A represents null or a group of atoms for constituting a naphthalene ring as a whole which may also have a substituent as mentioned above, and further A may be a substituent similar to the above $R_1$ to $R_5$.

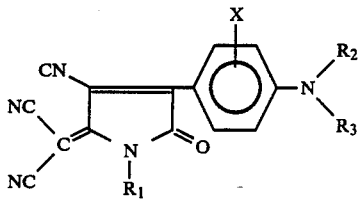

(III)

wherein: $R_1$, $R_2$ and $R_3$ each represent a hydrogen atom, an alkyl, cycloalkyl, alkenyl, alkynyl or phenyl group, and X represents a hydrogen atom, a halogen atom, an alkyl, alkoxy, NHCOR' or $NHSO_2R'$ group (R' is the same as the above $R_1$).

The dyes represented by the above formula (II) are obtained by the coupling method known in the art between phenylenediamine compounds and phenols or naphthols.

Preferable dyes of the above formula (II) in the present invention are those in which A is null, $R_1$ is a NHCOR (R is the same as defined above) group existing at the 1-position and those wherein, when A constitutes a naphthalene ring as a whole, $R_1$ is a CONHR or CONRR' (R, R' are the same as defined above) group existing at the 1-position, particularly preferably those of the above preferable dyes wherein $R_4$ and/or $R_5$ is a $C_2$ to $C_{10}$ alkyl group, and at least one of $R_4$ and $R_5$ has a polar group such as a hydroxyl group or a substituted hydroxyl group, amino group, substituted amino group, cyano group, etc., to give the best results, namely, excellent heat migratability, dyeability for heat transferable material, heat resistance during transfer, color forming property, color reproducibility and at the same time migration resistance after transfer, etc. and, further, excellent fastness, particularly storability and light resistance.

The molecular weight may be 310 or more, preferably 350 or more, more preferably 380 or more.

Preferable specific examples of the dyes in the present invention are shown below in Table 2.

TABLE 2

| No. | | Molecular Weight |
|---|---|---|
| 2-1 | 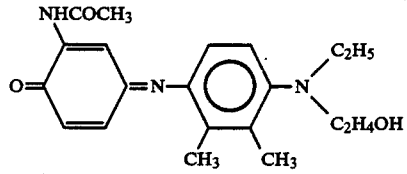 | 397.0 |
| 2-2 | 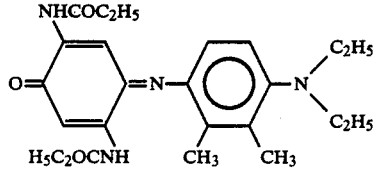 | 425 |
| 2-3 | 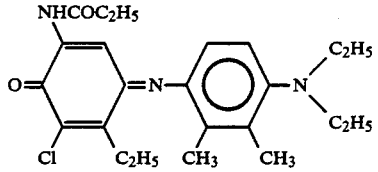 | 415.5 |

TABLE 2-continued

| No. | | Molecular Weight |
|---|---|---|
| 2-4 | 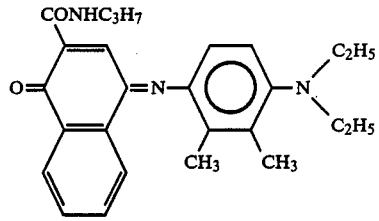 | 417 |
| 2-5 | 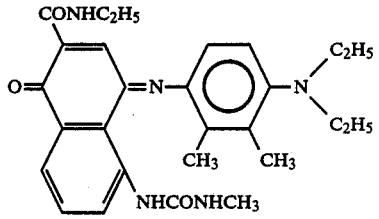 | 475 |
| 2-6 | 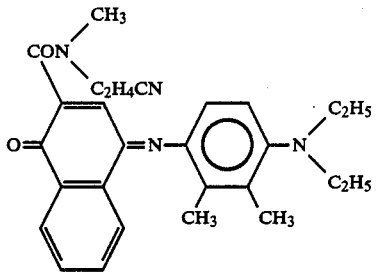 | 442 |
| 2-7 | 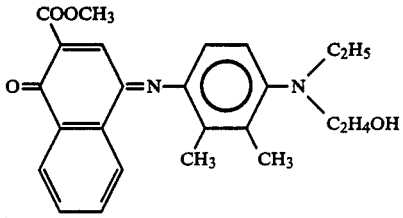 | 406 |

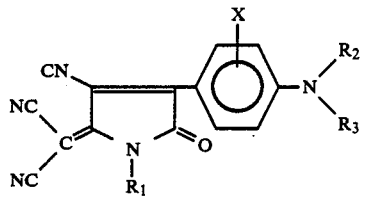

(III)

In the above formula (III), $R_1$, $R_2$ and $R_3$ each represent a hydrogen atom, an alkyl, cycloalkyl, alkenyl, alkynyl or phenyl group, and X represents a hydrogen atom, a halogen atom, an alkyl, alkoxy, NHCOR' or $NHSO_2R'$ group (R' is the same as the above $R_1$).

In the case of the dyes of the above formula (III), preferable specific examples of the compound are as shown below in Table 3.

TABLE 3

| No. | $R_1$ | $R_2$ | $R_3$ | X | Molecular Weight |
|---|---|---|---|---|---|
| 3-1 | $-C_4H_9$ | $C_4H_9$ | $-(CH_2)_3$-ph | H | 491 |
| 3-2 | H | $C_2H_5$ | $C_2H_4OH$ | $CH_3$-1 | 347 |

TABLE 3-continued

| No. | $R_1$ | $R_2$ | $R_3$ | X | Molecular Weight |
|---|---|---|---|---|---|
| 3-3 | $-CH_3$ | $-C_3H_7$ | $-C_2H_4$-ph | H | 421 |

Magenta dyes

At least one dye selected from the group consisting of the following formulae (IV) through (VIII):

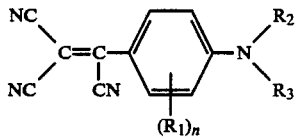

(IV)

wherein: $R_1$ represents a substituent such as a hydrogen atom, a halogen atom, an alkyl group which may also have substituent, an aryl, cycloalkyl, arylalkyl, alkoxy, acylamino, aminocarbonyl group, etc.; n represents 1 or 2; and $R_2$ and $R_3$ each represent an alkyl or substituted alkyl group.

In the above case, the molecular weight is preferably 270 or more, more preferably 330 or more. At least one of $R_1$–$R_3$ should preferably have a polar group.

A preferable specific example is one wherein $R_1=H$, $n=1$, $R_2=C_8H_{17}$, $R_3=C_8H_{17}$, with a molecular weight of 418. This compound has excellent fastness, with a recording density of 1.53.

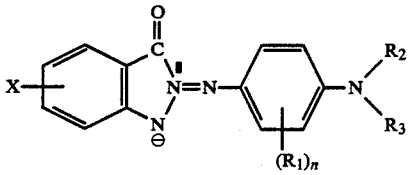

(V)

wherein: $R_1$ represents a substituent such as a hydrogen atom, a halogen atom, an alkyl group which may also have substituent, a cycloalkyl, arylalkyl, alkoxy, acylamino, aminocarbonyl group, etc.; n represents 1 or 2; $R_2$ and $R_3$ each represent an alkyl or substituted alkyl group; and X represents a hydrogen atom or one or more substituent.

According to the present invention, when an indazolone type dye having the basic structure as shown by the above formula (V) is used as the dye for heat transfer sheet, unexpectedly high heat migratability is exhibited, and yet after transfer an image with excellent fastness, particularly excellent storability and light resistance can be obtained. The above effect is found to be further marked particularly when the molecular weight of the dye is 310 or more, preferably 350 or more, more preferably 380 or more.

The indazolone type dye represented by the above formula (V) is obtained according to the preparation method known in the art in which an N,N-dialkyl-p-phenylenediamine or its derivative is reacted with an indazolone type coupler.

Among the above dyes obtained as described above, particularly preferable dyes are those wherein: $R_1$ in the above formula is a hydrogen atom, a halogen atom, a lower alkyl group such as methyl, ethyl, propyl, or butyl or an alkoxy group such as methoxy, ethoxy, propoxy, and butoxy; $R_2$ and $R_3$ are each a hydroxyl group, amino group, sulfonylamino group, aminocarbonyl group, aminosulfonyl group, alkoxycarbonyl group, alkoxysulfonyl group, cyano group, alkoxy group, phenyl group, cycloalkyl group, a $C_1$–$C_{20}$ alkyl group such as methyl, ethyl, propyl, butyl, pentyl, hexyl, heptyl, octyl, nonyl, decyl, undexyl, dodexyl, or hexadecyl, which may have a polar substituent such as a halogen atom or a nitro group; and X is a hydrogen atom or the above various polar substituent or the above non-polar substituent. These groups should be selected so that the molecular weight of the dye will be 310 or more, preferably 350 or more, more preferably 380 or more.

According to the results of our study, by selecting as $R_1$ to $R_3$ and X groups other than hydrogen, for example, substituted or unsubstituted alkyl groups, in the dyes of the above formula (V), the molecular weight of the dye can surpass 310, 350 or 380. However, in the dyes of the above formula, contrary to the general way of thinking of the prior art, these dyes tend to be lowered in melting point, and when such a dye is utilized as the dye for heat transfer, it has been found that the heat migrating speed of the dye from the heat transfer sheet to the transferable sheet is increased even by a very short time of heating with a thermal head, etc., and yet an image with excellent fastness, particularly excellent storability and light resistance, can be obtained.

In contrast, even in the case of an indazolone type dye of the above formula (V), when it has a molecular weight less than 300, the color forming density, etc. may be satisfactory, but the image formed has inadequate storability or light resistance.

The above preferable dyes are remarkably improved in solubility in organic solvents for general purpose such as methyl ethyl ketone, toluene, methanol, isopropyl alcohol, cyclohexanone, and ethyl acetate, or mixtures thereof to be used in preparation of heat transfer sheets. In the dye layer formed on the heat transfer sheet, the dye can exist in a noncrystalline or low crystalline state, and therefore the dye can easily heat migrate with remarkably less heat imparted as compared with a highly crystalline existing state as in the case of the dyes of the prior art.

Preferably specific examples of the dye (V) in the present invention are shown below. The following Table 4 shows substituents $R_1$ to $R_3$, n and X.

TABLE 4

| No. | $R_1$ | n | $R_2$ | $R_3$ | X | Molecular Weight |
|---|---|---|---|---|---|---|
| 4-1 | H | 1 | $C_2H_5$ | $C_2H_4OH$ | H | 311 |
| 4-2 | $OC_2H_5$ | 1 | $C_2H_5$ | $C_2H_5$ | H | 338 |
| 4-3 | $OC_2H_5$ | 1 | $C_2H_5$ | $C_2H_5$ | Cl | 372.5 |

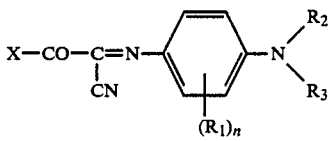

(VI)

Wherein: $R_1$ represents a substituent such as a hydrogen atom, a halogen atom, an alkyl group which may also have a substituent, an aryl, cycloalkyl, arylalkyl, alkoxy, acylamino, aminocarbonyl group, etc.; n represents 1 or 2; $R_2$ and $R_3$ each represent an alkyl or substituted alkyl group, or $R_2$ and $R_3$ taken together may also form a ring; and X represents a substituted or unsubstituted phenyl, naphthyl, furan or coumarone group.

We have found that the cyanoacetyl type dye having the basic structure as represented by the above formula (VI) exhibits an unexpectedly high heat migration speed, and yet, after transfer, an image having excellent fastness, particularly excellent storability and light resistance can be obtained. Particularly, the above effect becomes further marked when the molecular weight of the dye is 310 or more, preferably 350 or more, more preferably 380 or more.

The cyanoacetyl type dye represented by the above formula is obtained by the known preparation method in which an N,N-dialkyl-p-phenylenediamine or its derivative is reacted with a cyanoacetyl type coupler.

Among the dyes (VI) obtained as described above, particularly preferable dyes are those wherein: $R_1$ in the above formula is a hydrogen atom, a halogen atom, a lower alkyl group such as methyl, ethyl, propyl, or butyl, or an alkoxy group such as methoxy, ethoxy, propoxy, or butoxy; $R_2$ and $R_3$ are each a hydroxyl group, amino group, sulfonylamino group, aminocarbonyl group, aminosulfonyl group, alkoxycarbonyl group, alkoxysulfonyl group, cyano group, alkoxy group, phenyl group, cycloalkyl group, a $C_1$–$C_{20}$ alkyl group such as methyl, ethyl, propyl, butyl, pentyl, hexyl, heptyl, octyl, nonyl, decyl, undecyl, dodecyl, or hexadecyl, which may have a polar substituent such as a halogen atom or nitro group; and X is a hydrogen atom or a phenyl group, naphthyl group, furan group or coumarone group which may also have the above various polar substituents or the above non-polar substituent. These groups should be selected so that the molecular weight of the dye will be 310 or more, preferably 350 or more, more preferably 380 or more.

According to the results of our study, by selecting as $R_1$ to $R_3$ and X groups other than hydrogen, for example, substituted or unsubstituted alkyl groups, in the dyes of the above formula (VI), the molecular weight of the dye can surpass 350 or 380. However, in the dyes of the above formula, contrary to the general way of thinking of the prior art, these dyes tend to be lowered in melting point, and when such a dye is utilized as the dye for heat transfer, it has been found that heat migrating speed of the dye from the heat transfer sheet to the transferable sheet is increased even by a very short time of heating with a thermal head or the like, and yet that an image with excellent fastness, particularly excellent storability and light resistance, can be obtained.

In contrast, even in the case of a cyanoacetyl type dye of the above formula (VI), when it has a molecular weight less than 300, the color forming density, etc. may be satisfactory, but the image formed has inadequate storability or light resistance.

The above preferable dyes are remarkably improved in solubility in organic solvents for general purpose such as methyl ethyl ketone, toluene, methanol, isopropyl alcohol, cyclohexanone, and ethyl acetate, or mixtures thereof to be used in preparation of a heat transfer sheet, and, in the dye carrying layer formed on the heat transfer sheet, the dye can exist in a noncrystalline or low crystalline state, and therefore the dye can easily heat migrate with remarkably less amount of heat imparted as compared with the highly crystalline existing state in the case of the dyes of the prior art.

Preferable specific examples of the dye in the present invention are shown below. The following Table 5 shows substituents X, $R_1$ to $R_3$ and n in the formula (VI).

TABLE 5

| No. | X | $R_1$ | n | $R_2$ | $R_3$ | Molecular Weight |
|---|---|---|---|---|---|---|
| 5-1 | 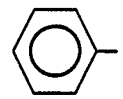 | $CH_3$ | 1 | $C_2H_5$ | $C_2H_4OH$ | 335.4 |
| 5-2 | 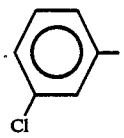 | $CH_3$ | 1 | $C_2H_5$ | $C_2H_4OH$ | 369.9 |
| 5-3 | 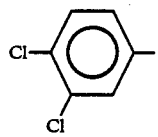 | $CH_3$ | 1 | $C_2H_5$ | $C_2H_4OH$ | 404.3 |
| 5-4 | 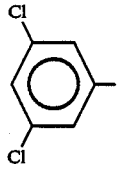 | H | 1 | $C_2H_5$ | $C_2H_4OH$ | 404 |

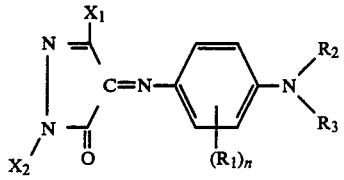

(VII)

wherein: $X_1$ and $X_2$ each represent a hydrogen atom, a halogen atom, an alkyl group which may also have substituent, an aryl or amino group; $R_1$ represents a substituent such as a hydrogen atom, a halogen atom, an alkyl group which may also have substituent, an amino, aryl, cycloalkyl, arylalkyl, alkoxy, acetylamino, aminocarbonyl group, etc.; n represents 1 to 4; and $R_2$ and $R_3$ each represent a hydrogen atom, an alkyl group which may also have substituent, or $R_1$ and $R_2$ taken together may also form an alicyclic or aromatic ring.

Also, in the above case, the molecular weight is 310 or more, preferably 350 or more, more preferably 380 or more. At least one of $R_1$ to $T_3$ preferably has a polar group.

Preferable specific examples are shown below in Table 6.

TABLE 6

| No. | $X_1$ | $X_2$ | $R_1$ | n | $R_2$ | $R_3$ | Molecular Weight |
|---|---|---|---|---|---|---|---|
| 6-1 | $CH_3$ | 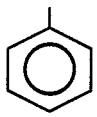 | $CH_3$ | 1 | $C_2H_5$ | $C_2H_5$ | 348 |

TABLE 6-continued

| No. | $X_1$ | $X_2$ | $R_1$ | n | $R_2$ | $R_3$ | Molecular Weight |
|---|---|---|---|---|---|---|---|
| 6-2 | $NH_2$ | 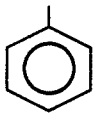 | $CH_3$ | 1 | $C_2H_5$ | $C_2H_5$ | 349 |
| 6-3 | $NH_2$ | 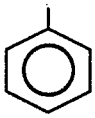 | $CH_3$ | 1 | $C_2H_5$ | $C_2H_5$ | 365 |

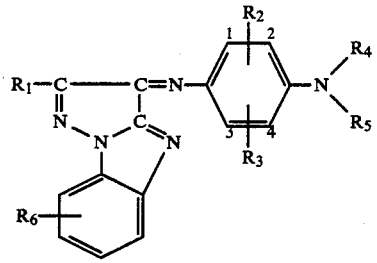

(VIII)

wherein: $R_1$ represents an alkyl, alkoxycarbonyl group, an aryl group which may also have substituent or an amino group; $R_2$ or $R_3$ represents a hydrogen atom, a halogen atom, an alkyl, cycloalkyl, alkoxy, acylamino, aminocarbonyl, alkylaryl or aryl group; $R_4$ and $R_5$ each represent an alkyl, aralkyl, aryl group or hydrogen atom; and $R_6$ represents a substituent similar to $R_2$ or $R_3$.

Also, in the above case, the molecular weight is 310 or more, preferably 350 or more, more preferably 380 or more. At least one of $R_1$ to $R_3$ preferably has a polar group.

Preferable specific examples are shown below in Table 7.

TABLE 7

| No. | $R_1$ | $R_2$ | $R_3$ | $R_4$ | $R_5$ | $R_6$ | Molecular Weight |
|---|---|---|---|---|---|---|---|
| 7-1 | $CH_3$ | H | H | $C_2H_5$ | $C_2H_5$ | H | 331 |
| 7-2 | $COO_2H_5$ | $CH_3$ | H | $C_2H_5$ | $C_2H_4CN$ | H | 428 |
| 7-3 | $NH_2$ | $CH_3$ | H | $C_2H_5$ | $C_2H_4OH$ | H | 362 |

According to the present invention as described above, as already partially explained, the dyes of the above formula (I) to (VIII) to be used in the heat transfer sheet of the present invention, in spite of their having remarkably higher molecular weights as compared with sublimatable dyes (molecular weights of about 150 to 250) used in the heat transfer sheet of the prior art, can exhibit excellent heating migratability, dyeability and color forming property of heat transferable material, and also will not migrate in the heat transferable material or bleed out onto the surface after transfer because of their having specific structures and having substituents at specific positions.

Accordingly, the image formed by use of the heat transfer sheet of the present invention has excellent fastness, particularly migration resistance and staining resistance, and therefore will not be impaired in sharpness of the image formed or stain other articles even when stored over a long term, thus solving various problems of the prior art.

The heat transfer sheet of the present invention is characterized by the use of specific dyes as described above, and other features of constitution thereof may be the same as those of the heat transfer sheets of the prior art.

FIG. 1 is a sectional view showing a basic embodiment of the heat transfer sheet of the present invention, in which a dye carrying layer 2 is formed on one surface of the substrate sheet 1. In carrying out practically heat-sensitive printing by the use of this heat transfer sheet, by superposing an image-receiving sheet (not shown) which is the heat transferable sheet on the side of the dye carrying layer 2 and applying a heating printing means such as a thermal head 3 from the substrate sheet side, a printed image is formed on the image-receiving sheet.

Figure 2:
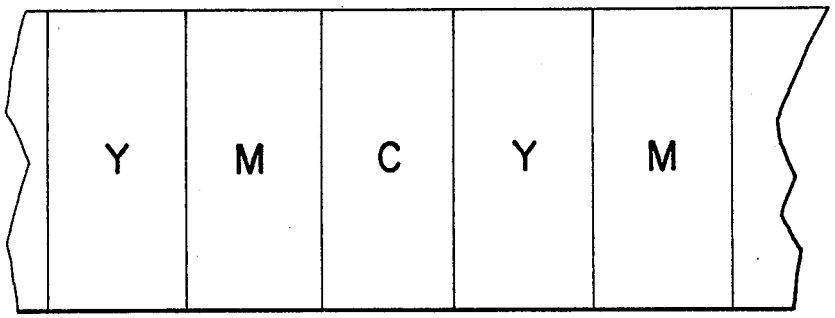
FIG. 2 and FIG. 4 are fragmentary plan views respectively showing examples of the heat transfer sheet according to the present invention.
Figure 3A:
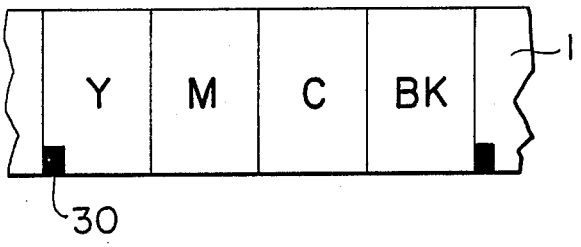
FIG. 3(*a*) is a fragmentary plan view of one example of the heat transfer sheet according to the present invention.
Figure 3B:
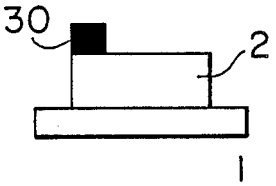
Figure 3C:
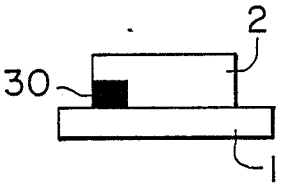
Figure 3D:
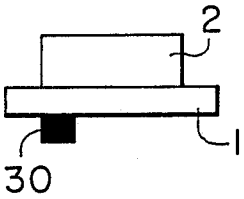
Figure 4A:
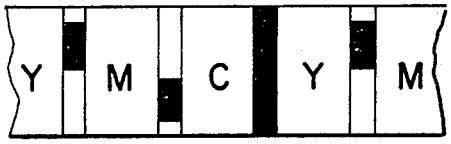
Figure 4B:
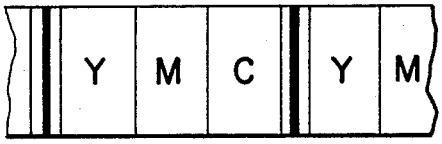
Figure 4C:
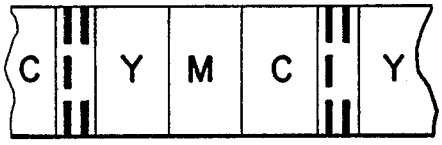
Figure 4D:
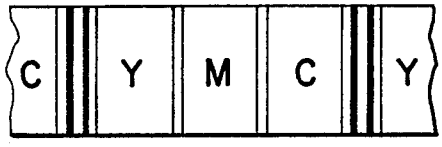
Figure 4E:
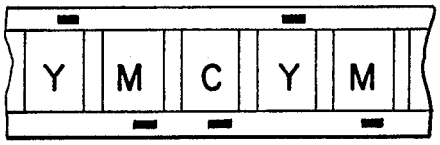
Figure 4F:
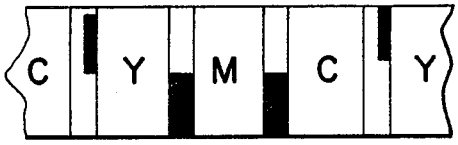
Figure 4G:
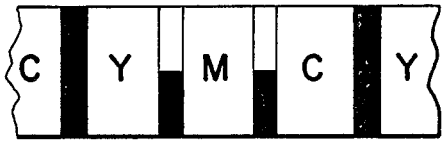
Figure 4H:
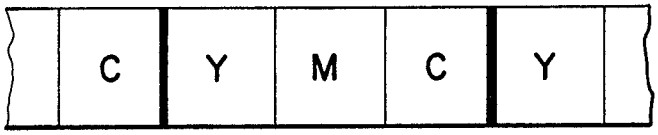
Figure 4I:
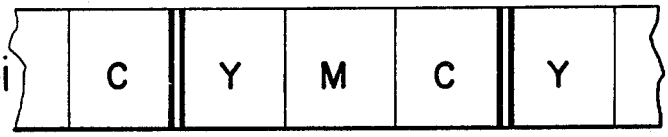
Figure 4J:
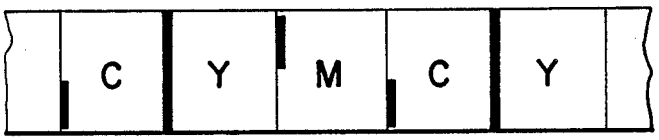
Figure 4K:
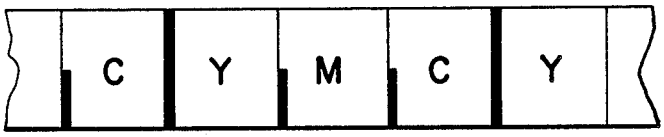
Figure 4L:
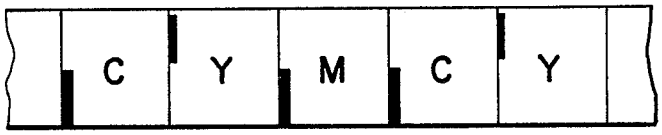
Figure 4M:
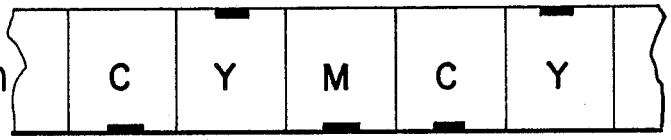
Figure 4N:
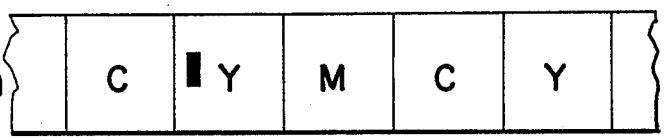
Figure 4O:
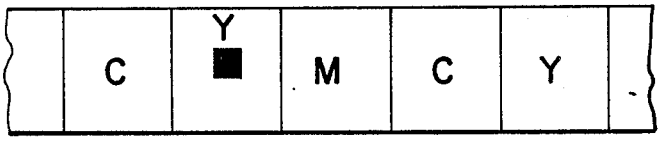

FIG. 2 is a plan view showing one example of the present invention, in which the heat transfer sheet is generally formed by coating separately dye carrying layers comprising Y (yellow), M (magenta) and C (cyan) in a certain order as shown in this figure. In the present invention, these modes of practice are not limitative, and various other known modes can be included.

The respective constituent materials of the heat transfer sheet will now be described in detail.

Substrate sheet

As the substrate sheet to be used in the heat transfer sheet of the present invention containing the above dyes, any of those known in the art having heat resistance and strength to some extent may be used. Examples of such substrate sheets are papers, various processed papers, polyester film, polystyrene film, polypropylene film, polysulfone film, polycarbonate film, polyvinyl alcohol film, and Cellophane, with a thickness of about 0.5 to 50 μm, preferably 3 to 10 μm. A particularly preferably sheet is polyester film.

Dye layer

The dye layer to be provided on the surface of the substrate sheet as described above is a layer having the above dyes carried with any desired binder resin.

As the binder resin for carrying the above dyes, any of those known in the art can be used. Preferable examples are cellulose type resins such as ethyl cellulose, hydroxyethyl cellulose, ethylhydroxy cellulose, hydroxylpropyl cellulose, methyl cellulose, cellulose acetate, and cellulose acetate butyrate; vinyl type resins such as polyvinyl alcohol, polyvinyl acetate, polyvinyl butyral, polyvinyl acetoacetal, polyvinyl pyrrolidone, and polyacrylamide. Among these, polyvinylbutyral and polyvinyl acetoacetal are particularly preferred for their heat resistance, migratability of dyes, etc.

Other than those mentioned above, an ionomer resin crosslinked with a metal may also be used as the binder. By the use of such ionomer resin, sensitivity can be increased.

Further, as the binder, the reaction product of an active hydrogen compound such as polyvinyl butyral, polyvinyl acetoacetal, polyvinyl formal, polyester polyol, and acryl polyol with an isocyanate selected from diisocyanates or polyisocyanates can be employed. By the use of these reaction products, the heat transfer sheet can be used during heating recording with its running speed made smaller than the running speed of the heat transferable sheet. As a result, useless misuse of the heat transfer sheet can be avoided, and the heat transfer sheet can be observed with its recorded contents seen with difficulty, whereby secretiveness of the information can be maintained.

The dye layer of the heat transfer sheet of the present invention can be formed basically of the above material, or otherwise can also include various additives similar to those known in the art, if necessary.

As such an additional additive, an ink flowability modifier can be added. Such an ink flowability modifier comprises organic powder which can be softened with heat or inorganic powder of a particle size of 1 μm or less, which may be suitably selected from synthetic wax, polyethylene wax, amide wax, aliphatic ester compound, silicone resin and fluorine resin. Thus, by the addition of an ink flowability modifier into the ink composition, "swimming" (wavy unevenness) during formation of the dye layer on the substrate sheet can be removed, whereby irregularity of the image is eliminated. Also, continuous gradation can be obtained, with further enhancement of heat sensitivity, and an image also of excellent stability and durability can be obtained.

The dye layer is formed preferably by adding the above dyes, the binder resin and other optional components in an appropriate solvent, dissolving or dispersing the respective components to form a coating solution or an ink for formation of a dye layer, which is then coated and dried on the above substrate sheet.

The dye layer thus formed has a thickness of about 0.2 to 5.0 μm, preferably 0.4 to 2.0 μm, and the above dye in the dye layer should exist suitably in an amount of 5 to 70% by weight, preferably 10 to 60% by weight, of

Mold release layer

The heat transfer sheet of the present invention as described above is amply useful as such for heat transfer, but a sticking preventive layer, namely, a mold release layer may also be provided further on the surface of the dye carrying layer. By provision of such a layer, adhesion between the heat transfer sheet and the heat transferable material can be prevented, whereby an even higher heat transfer temperature can be used to form an image with further excellent density.

As the mold release layer, one on which an inorganic powder for prevention of sticking has thereby been caused to adhere can exhibit a considerable effect. Further, a mold release layer can be formed with a thickness of 0.01 to 5 μm, preferably 0.05 to 2 μm, from a resin of excellent mold release property, such as silicone polymer, acrylic polymer, or fluorinated polymer.

The inorganic powder or mold release polymer can exhibit ample mold release effect even when included in the dye layer.

For example, in the present invention, it is also possible to mix a hot mold release agent containing a polymer having a long chain alkyl component in the side chain of the polymer in the binder for the dye layer (or resin for forming an image-forming layer of heat-transfer material). As the mold release agent in this case, stearylated polyvinyl butyral, stearylated acrylic polymer, stearylated vinyl polymer, etc. can be employed.

As the hot mold release agent having the same effect as described above, a polymer having organopolysiloxane components in the main chain or the side chain of the polymer can also be used. As the hot mold release agent in this case, silicone-modified polyesters, silicone-modified polyurethanes, silicone-modified polyamides and copolymers having silicone grafted onto the side chain can be used.

Details of the mold release agent are disclosed in U.S. Pat. No. 4,559,273 granted to us.

Primer layer

In the present invention, for improvement of adhesiveness between the substrate sheet and the dye layer, a primer layer comprising a resin composition of a thermoplastic resin such as polyester resin or polyurethane resin, and a curing agent, such as isocyanate, added if necessary, or an organic titanate is provided.

As the primer layer, it is preferable to use an organic titanate from the standpoint of adhesiveness. As the organic titanate, those with the four bonds of titanium atoms replaced by alkoxy groups or acylate groups, those having 10 or less, preferably 5 or less, carbon atoms are used. Examples of useful organic titanates are:

tetra-i-propoxytitanium,
tetra-n-butoxytitanium,
di-i-propoxy-bis(acetylacetona)titanium,
tetrakis(2-ethylhexoxy)titanium,
poly(tetra-i-propoxy)titanium, and By dissolving the organic titanate as described above in a solvent capable of dissolving the titanate in an amount of about 0.1 to 10% by weight, coating the solution, and then drying, a primer layer is formed. A preferable coated amount is 0.01 to 1 g/m$^2$, and good adhesiveness can be exhibited even with a small coated amount. The adhesive layer obtained is remarkably thinner than the adhesive layer of the prior art, and also has higher thermal conductivity than the organic polymer adhesive layer in general, whereby the drop in the efficiency of heat utilization from the thermal head is reduced, and recording with excellent image density can be accomplished.

In the case where such a primer layer is formed, the dye in the dye layer is apt to migrate to the primer layer or the dye layer during printing. For this reason, the printed image density tends to become lower. In order to overcome this problem, it is desirable to form a second primer layer having a low dye dyeability between the abovementioned primer layer and the dye layer. The resin with low dye dyeability used for the second primer layer may include a hydrophilic or water soluble resin such as a styrene-(meta)acrylic acid copolymer, or a styrene-maleic acid copolymer. These hydrophilic and water soluble resins have a merit in that they are insoluble in the solvent for forming the dye layer while the dye layer is formed on the second primer layer. These resins also have a merit in that they provide a thin film.

Backing layer

In the present invention, on the back surface side of the heat transfer sheet, namely, the surface on the side where the thermal head is contacted, a backing layer such as heat-resistant layer may be provided for prevention of deleterious influence due to the heat of the thermal head.

As the heat-resistant layer formed for such purpose, there can be used, for example, a layer of excellent heat resistance comprising a cured product obtained by curing a synthetic resin curable by heating with a curing agent.

Further, in the present invention, for making the running of the sheet smooth simultaneously with prevention of the so-called sticking phenomenon, a heat-sensitive slip layer can also be further provided on the surface of the heat-resistant layer as described above. For this heat-resistant slip layer, (a) a reaction product of a thermoplastic resin containing a hydroxyl group with an isocyanate, (b) a phosphoric acid ester type surfactant or an alkali metal salt or alkaline earth metal salt of a phosphoric acid type surfactant, and (c) a filler can be used.

As the thermoplastic resin containing a hydroxyl group in this case, it is possible to use, particularly preferably, a polyvinyl butyral resin or a polyvinyl acetoacetal resin with a molecular weight of 60,000 to 200,000, a Tg of 60° to 130° C. and 15 to 40% by weight of the vinyl alcohol moiety. Also, the above reaction product (b) is particularly preferably one obtained by the reaction with an equivalent ratio of isocyanate groups/hydroxyl groups ranging from 0.8 to 2.5.

Further, as the above surfactant, those with a hydrophobic group of the phosphoric acid ester which is a straight aliphatic hydrocarbon group, is preferably used. Also, as the filler to be used for the heat-resistant layer and the heat-resistant slip layer, calcium carbonate, talc, aluminosilicate, carbon, etc., can be used.

Otherwise, details of the above constitution are also disclosed in the specification of Japanese Patent Application No. 52284/1987, and the constitution of the backing layer to be applied in the present invention is also inclusive of those disclosed in said specification.

In the present invention, as the substrate sheet for the heat transfer sheet, films comprising synthetic resins such as polyethylene terephthalate, polyester resin provided with naphthalene nucleus as the dicarboxylic acid component, PVA resin, polyamide resin, polycarbonate resin, polyallylate resin, polyethersulfone resin, polyether ketone resin, polyether imide resin, polyimide resin, and aromatic polyamide resin, are used. When films containing lubricants in dissolved or dispersed state in the above synthetic resins are used, even when no backing heat-sensitive slip layer is formed, no sticking occurs between the thermal head and the heat transfer sheet, whereby smooth printing is achieved. As the lubricant in the above case, it is possible to use lubricants soluble in synthetic resins such as silicone, phosphates, phosphate salts, and surfactants, lubricants dispersible in synthetic resins such as talc, fluorine type powder, and polyethylene wax. These lubricants can be mixed with the above synthetic resin and formed into films by extrusion molding or casting molding to obtain substrate sheets.

Also, the heat-resistant slip layer provided on the back surface of the heat transfer sheet should desirably comprise a material with low dyeability for the dye of the heat-transfer layer and have the effect of preventing the dye from migrating to the back surface heat-resistant slip layer when the heat-transfer sheet is stored in wound-up state.

Detection marks

In the heat-transfer sheet of the present invention, for example, detection marks for detecting physically the positions of the respective colors of the heat transfer sheet for formation of a multi-color image as shown in FIG. 2 can be provided.

FIG. 3(*a*) shows one embodiment in which detection marks 30 are provided to show the series of the foreheads of Y (yellow), M (magenta), C (cyan) and Bk (black). The detection marks 30 are detected by a printer and have the function of informing the printer of the hues of the respective regions.

FIGS. 3(*b*), 3(*c*), and 3(*d*) are sectional views showing the heat transfer sheet in FIG. 3 cut in the width direction, and showing the relationship between a detection mark, the substrate sheet, and the dye layer.

Among these, that shown in 3(*b*) is better in detection efficiency as compared with those in 3(*c*) and 3(*d*), because loss of the rays during incidence on the dye layer is less, and the rays are absorbed at the detection mark. The detection mark can be electrical, magnetic or optical depending on the detecting means. An optical detection mark is advantageous because the detecting means can be simplified.

Representatives of the optical detection mark are those containing IR-ray intercepting substances, particularly carbon black which does not transmit IR-ray therethrough.

The device for detecting the IR-ray intercepting detection mark comprises, for example, an IR-ray projector such as IR-ray emitting LED arranged on one surface of the heat transfer sheet, an IR-ray sensor, a reflection plate arranged on the other surface of the heat transfer sheet and a computer connected to the IR-ray sensor. On the basis of the signals from the IR-ray sensor, various actuations are directed to the printing device. Particularly, when the near infra-red ray of 900 to 2,500 nm is used as the IR-ray, since the dye in the heat transfer layer cannot absorb the near infra-red ray in this range, the IR-ray is transmitted through the heat transfer layer irrespectively of the hues, whereby the detection efficiency of the IR-ray intercepting detection mark can be increased.

| Ink composition (1) for formation of detection mark: | |
|---|---|
| Carbon black | 10 parts |
| Vinyl chloride/ vinyl acetate copolymer resin | 15 parts |
| Solvent (MEK/Toulene = 1/1) | 75 parts |
| **Ink composition (2) for formation of detection mark:** | |
| Carbon black | 10 parts |
| Vinyl chloride/acrylic copolymer | 12 parts |
| Cellulose acetate butyrate | 3 parts |
| Isocyanate | 1 part |
| Solvent (MEK/Toulene) | 75 parts |

Printing method

The heat transferable material to be used for formation of an image by the use of a heat transfer sheet as described above may be any material of which the recording surface has dye receptability for the dye as described above, and when it is a paper, metal, glass, synthetic resin, etc. having no dye receptability, one measure is to form a dye receiving layer on at least one surface thereof.

Examples of the resin for forming the dye receiving layer of the heat transferable material are the following synthetic resins:

(a) those having ester bonds:

polyester resin, polyacrylate resin, polycarbonate resin, polyvinyl acetate resin, styrene-acrylate resin, vinyl toluene-acrylate resin, etc.;

(b) those having urethane bonds:

polyurethane resins, etc.;

(c) those having amide bonds:

polyamide resins, etc.;

(d) those having urea bonds:

urea resins, etc.; and (e) other resins having bonds with higher polarity: polycaprolactone resin, styrene-maleic anhydride resin, polyvinyl chloride resin, polyacrylonitrile resin, etc.

Among these, polyester resin and vinyl chloride/vinyl acetate copolymer are preferred.

As the heat energy imparting means to be used in carrying out heat transfer printing by the use of the heat transfer sheet of the present invention and the recording material (image-receiving sheet) as described above, any of means known in the art can be used. For example, by means of a thermal printer (e.g., Thermal Printer TN-5400, produced by Toshiba K.K., Japan), by controlling the recording time and imparting a heat energy of about 5 to 100 mJ/mm$^2$, the desired object can be amply accomplished.

Also, when image formation is performed by the use of the heat transfer sheet of the present invention, for obtaining an image with a large image density range, an image can be formed by a plurality of cycles of overlapping printing. More specifically, in forming the image according to the heat-sensitive transfer system on an image-receiving sheet by the use of the heat transfer sheet of the present invention, by carrying out transfer by overlapping at least twice or more the same image pattern on said image-receiving sheet, a transferred image with a larger density range, hence a clear and improved image quality can be obtained.

Cassette for heat transfer sheet

The heat transfer sheet of the present invention can be used generally in a state of its being wound around bobbins, but it becomes important in operation to house such heat transfer sheet so that it can be mounted on and dismounted from a printer in a simple manner.

The cassette to be used in the present invention for this purpose is adapted to house a delivery roll for the heat transfer sheet and a take-up roll and is formed from a plastic containing a lubricant. For example, by the use of a cassette in which at least one of the cassette body and lid which are plastic molded products and the bobbins comprises a plastic containing a lubricant, generation of dust can be prevented, whereby white dropout of the printed image formed by a printer can be prevented as much as possible to contribute to formation of a clear image.

The delivery roll and the take-up roll of the heat transfer sheet wound on the bobbins is subjected to moisture barrier packaging after or before assembled in a cassette. Also, if necessary, a cushioning material may be employed. After such moisture barrier packaging, the package may be placed in a box by itself or together with a packaged image-receiving sheet (moisture barrier packaged, if necessary).

The cassette used generally has a sectional shape of spectacles or otherwise of the letter S. When a cassette as described above is not used, the delivery roll and the take-up roll are packaged for moistureproofness with the use of a cushioning material and mounted on a heat-sensitive printer.

When the heat transfer sheet is wound on a delivery roll, the terminal end is first fixed by adhesion to the winding core of the delivery roll by a double adhesive coated tape. As the method for adhesion fixing, although both surfaces can be caused to adhere firmly with a strong adhesive tape so that the heat transfer sheet will not peel off from the winding core, in this case, during usage, the terminal end can be detected by detecting the variation of the torque imposed on the heat transfer sheet from the prescribed torque during ordinary operation at the time when transfer of the prescribed number of sheets has been completed.

Also, in addition to the above case, when adhesion fixing is carried out at the terminal end of the heat transfer sheet with the use of the double-coated tacky tape with different adhesive forces on the surfaces, for example, a double-coated tacky tape with greater adhesive force between the heat transfer sheet and the tacky tape than the adhesive force between the winding core and the tacky tape, since the heat transfer sheet is completely wound on the wind-up roll at the time when use of the heat transfer sheet is completed, the terminal end can be determined by detecting a variation in the torque at that time.

The heat transfer sheet may be fixed on the wind core so that the terminal end of the heat transfer sheet will be wound up by insertion thereof into a cutout formed in the longitudinal direction of the winding core.

In mounting the roll, the cassette body can be divided into the two portions of an upper part and a lower part to make mounting of the roll of the heat transfer sheet in the cassette easier. In this case, after mounting respectively the delivery roll and the wind-up roll, the upper and lower cassette body can be integrated by sealing according to a method such as ultrasonic sealing.

Also, when the delivery roll is mounted in the cassette, for prevention of jolting of the bobbin, the core of the bobbin may be supported with a mechanism such as a spring. Further, it is preferable to prevent the roll from reverse rotation by fitting a concave portion of the bobbin end and a concave portion of the cassette case simultaneously with placing a rubber against the portion.

Further, the external surface of the above cassette case or the heat transfer sheet itself housed in the cassette may be also provided with a display means for displaying information concerning the recordable number of picture faces and others. As for other items of information, they may be classified into the kinds of heat transfer sheets, for example, for Standard, for OHP, for Monochromatic, etc. The printing conditions can be altered by having these information items recognized by a printer.

The above information items may be displayed by the label of a bar code (either optical or magnetic), letters or color labels.

Alternatively, they can be displayed by the color of the cassette.

Alternatively, it is possible to practice such a method as sticking of a color label or sticking of a reflection plate, applying marks, letters or magnetic patterns of a bar code, etc. directly or indirectly by provision thereof on a separate sheet. Or, the method in which holes are opened or projections are provided on the cassette may also be employed.

Similarly, various information items may be also displayed in the heat transferable sheet or the cassette housing the sheet therein.

Information in this case may include front and back, head and tail, size, kind, etc.

Alternatively, in the heat transfer sheet, the heat transferable sheet or cassettes thereof, there may be also provided a hidden mark evidencing its genuineness, including printing with an ink discriminable by UV-ray irradiation, provision of an interference pattern, provision of a mark of drop-out color, etc.

EXAMPLES

An ink composition of the following composition for formation of a dye layer was prepared, coated and dried on a polyester film with a thickness of 4.5 μm provided on the back surface with a heat-resistant slip layer shown below to a coating amount after drying of 1.0 g/m$^2$ to obtain a heat transfer sheet of the present invention.

| | |
|---|---|
| Dye | 3 parts |
| Polybutyral resin | 4.5 parts |
| Methyl ethyl ketone | 46.25 parts |
| Toluene | 46.25 parts |

The heat-resistant layer was formed as described below.

An ink composition for heat-resistant layer comprising a composition shown below was prepared and coated on a substrate by means of a Myar bar #8 on the substrate sheet to a coated amount of 1.0 g/m$^2$, and then dried in hot air.

| Ink composition for heat-resistant slip layer | |
|---|---|
| Polyvinyl butyral resin ("Ethlec BX-1", produced by Sekisui Kagaku K.K., Japan) | 2.2 wt. parts |
| Toluene | 35.4 wt. parts |
| Methyl ethyl ketone | 53.0 wt. parts |
| Isocyanate ("Barnock D-750, produced by Dainippon Ink Kagaku K.K., Japan) | 6.8 wt. parts |
| Phosphoric acid ester (Plysurf A-208S", produced by Daiichi Kogyo Seiyaku K.K., Japan) | 1.6 wt. parts |
| Sodium phosphate ("Gafak RD 720", produced by Toho Kagaku K.K., Japan) | 0.6 wt. part |
| Talc ("Microace L-1, produced by Nippon Talc K.K., Japan) | 0.4 wt. part |
| Amine type catalyst ("Desmorapid PP", produced by Sumitomo-Bayern Urethane K.K., Japan) | 0.02 wt. part |

The film obtained was further subjected to curing by heating in an oven at 60° C. for 2 days. The isocyanate/-hydroxyl ratio in the above ink composition for heat-resistant slip layer was 1.8.

Next, on one of the surfaces of a synthetic paper (Yupo FPG #150, produced by Oji Yuka) as the substrate sheet was provided a coating solution with the following composition to a coated amount on drying of 10.0 g/m$^2$ and then dried at 100° C. for 30 minutes to obtain a heat transferable material.

| | |
|---|---|
| Polyester resin (Vylon 200, produced by Toyobo, Japan) | 11.5 wt. parts |
| Vinyl chloride-vinyl acetate copolymer VYHH, produced by UCC) | 5.0 wt. parts |
| Amino-modified silicone (KF-393, produced by Shinetsu Kagaku Kogyo, Japan) | 1.2 wt. parts |
| Epoxy-modified silicone (X-22-343, produced by Shinetsu Kagaku Kogyo, Japan) | 1.2 wt. parts |
| Methyl ethyl ketone/toulene/cyclohexanone (weight ratio 4:4:2) | 102.0 wt. parts |

The above heat transfer sheets of the present invention and comparative example and the above heat transferable sheet were respectively superposed on one another with the dye later and the dye receiving layer opposed to each other, and recording was performed with a thermal head under the conditions of a heat application voltage of 10V and a printing time of 4.0 msec. to obtain the results shown below in Table 8.

TABLE 8

| Dye No. | Color forming density | Storability | Light-resistance |
|---|---|---|---|
| 1-1 | 0.75 | ○ | ◎ |
| 1-2 | 0.92 | ○ | ○ |
| 1-3 | 1.01 | ○ | ○ |
| 1-4 | 0.87 | ○ | ○ |
| 2-1 | 1.31 | ◎ | ○ |
| 2-2 | 0.98 | ◎ | ○ |
| 2-3 | 1.01 | ◎ | ○ |
| 2-4 | 1.00 | ◎ | ○ |
| 2-5 | 0.79 | ◎ | ○ |
| 2-6 | 0.91 | ◎ | ○ |
| 2-7 | 1.76 | ◎ | ○ |
| 3-1 | 1.73 | ◎ | ○ |
| 3-2 | 2.20 | ◎ | ○ |
| 3-3 | 1.95 | ◎ | ○ |
| 4-1 | 2.48 | ◎ | ○ |
| 4-2 | 2.34 | ◎ | ○ |
| 4-3 | 1.54 | ◎ | ○ |
| 5-1 | 2.11 | ◎ | ○ |
| 5-2 | 2.10 | ◎ | ○ |
| 5-3 | 2.59 | ◎ | ○ |
| 5-4 | 2.47 | ◎ | ○ |
| 6-1 | 2.57 | ◎ | ○ |
| 6-2 | 2.25 | ◎ | ○ |
| 6-3 | 1.19 | ◎ | ○ |
| 7-1 | 2.65 | ◎ | ○ |
| 7-2 | 2.17 | ◎ | ○ |
| 7-3 | 2.55 | ◎ | ○ |

The above color forming density is a value measured by a Densitometer RD-918 produced by Macbeth Co, USA.

Storability was measured by leaving the recorded image to stand in an atmosphere of 50° C. for a long time, and represented as when the sharpness of the image was unchanged and there was no coloration of white paper when the surface was rubber with white paper, as when the sharpness was slightly lost and white paper was slightly colored, as Δ when sharpness was lost and white paper was colored, and as x when the image became unclear and white paper was markedly colored. Light resistance was measured according to JIS L 0842, and that with the class 3 or higher of initial fastness in the second exposure method of JIS L 0841 was rated as ◎, that similar to the class 3 as ○ and that lower than that class as x.

When, as the heat transfer sheet, is used (1) one obtained by coating an ink composition for the dye layer after coating of the organic titanate type primer composition to 0.05 g/m$^2$ (on drying) on the polyester film and (2) one obtained by coating the following titanate type primer composition on the polyester film, then coating of the hydrophilic primer composition with the following composition to 0.15 g/m$^2$ (on drying), followed by drying of the ink composition for formation of the dye layer, adhesion between the polyester film and the primer layer could be improved in the case where (1) was used. When (2) was used, migration of the dye to the substrate sheet side during printing became less to improve the printing density.

| Organic titanate type primer composition | |
|---|---|
| Tetr-i-propoxy titanium | 0.5 part |
| 2-Propanol | 50.5 parts |

-continued

| | |
|---|---|
| Toulene | 49.5 parts |
| Hydrophilic primer composition | |
| Aqueous styrene/maleic anhydride copolymer (Hilos X220, produced by Seiko Kagaku Kogyo, Japan) | 3.0 parts |
| Isopropanol | 74.0 parts |
| Water | 22.3 parts |
| 28% Aqueous ammonia | 0.7 part |

What is claimed is:

1. A heat transfer sheet, comprising a substrate sheet and a dye later formed on said substrate sheet, said dye layer comprising a layer containing at least one of yellow dyes, cyan dyes and magenta dyes, of which:

said yellow dyes are represented the following formula (I)

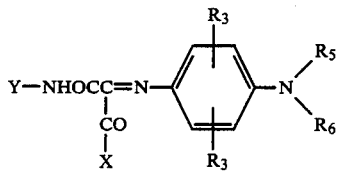

(I)

wherein:

X is a phenyl group which may have a substituent or a $R_7$—$C(CH_3)_2$— group ($R_7$ represents an alkyl, alkoxy, aryloxy or thioalkyl group);

Y is

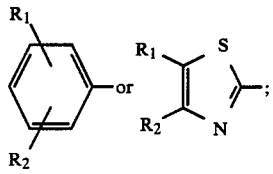

$R_1$ through $R_4$ each represent a halogen atom, an alkyl, cycloalkyl, alkoxy, acylamino, aminocarbonyl, alkylaryl, cyano or aryl group;

$R_5$ and $R_6$ each represent a hydrogen atom, an alkyl group which may also have a substituent, an aralkyl or aryl group;

said cyan dyes are represented by the following formula (III):

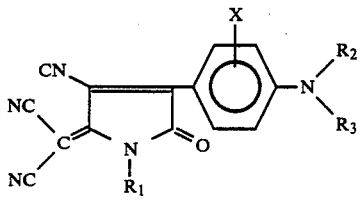

(III)

wherein $R_1$, $R_2$ and $R_3$ each represent a hydrogen atom, an alkyl, cycloalkyl, alkenyl, alkylnyl or phenyl group, and X represents a hydrogen atom, a halogen atom, an alkyl, alkoxy, NHCOR' or $NHSO_2R'$ group (R' is the same as the above $R_1$);

and said magenta dyes are each at least one dye selected from the group consisting of dyes represented by the following formula (V) through (VIII):

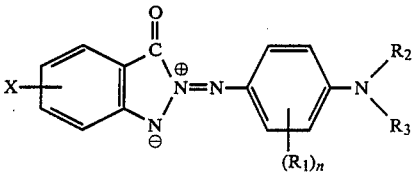

(V)

wherein:

$R_1$ represents a substituent such as a hydrogen atom, a halogn atom, an alkyl group which may also have a substituent, a cycloalkyl, arylalkyl, alkoxy, acylamino, or aminocarbonyl group n represents 1 or 2, $R_2$ and $R_3$ each represents an alkyl, or substituted alkyl group; and X represents a hydrogen atom or one of more substituents;

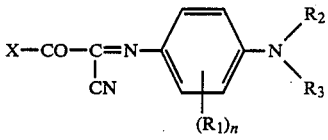

(VI)

wherein:

$R_1$ represents a substituent such as a hydrogen atom, a halogen atom, an alkyl atom, an alkyl group which may also have a substituent, an aryl, cycloalkyl, arylalkyl, alkoxy, cylamino, or aminocarbonyl group; n represents 1 or 2;

$R_2$ and $R_3$ each represent an alkyl or substituted alkyl group, or $R_2$ and $R_3$ taken together may also form a ring; and X represents a substituted or unsubstituted phenyl, naphthyl, furan or coumarone group;

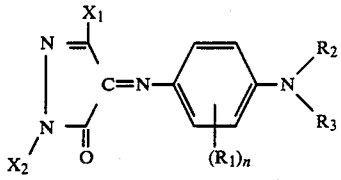

(VII)

wherein:

$X_1$ and $X_2$ each represent a hydrogen atom, a halogen atom, an alkyl group which may also have a substituent, an aryl or amino group;

$R_1$ represents a substituent such as a hydrogen atom, a halogen atom, an alkyl group which may also have a substituent, an amino, aryl, cycloalkyl, arylalkyl, alkoxy, acetylamino, or aminocarbonyl group;

n represents 1 to 4;

and $R_2$ and $R_3$ each represent a hydrogen atom, an alkyl group which may also have a substituent, or $R_1$ and $R_2$ taken together may also form an alicyclic or aromatic ring;

(VIII)

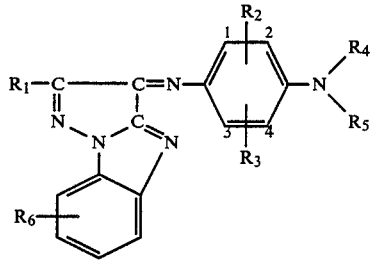

wherein:

$R_1$ represents an alkyl, alkoxycarbonyl group, an aryl group which may also have a substituent or an amino group;

$R_2$ or $R_3$ represents a hydrogen atom, a halogen atom, an alkyl, cycloalkyl, alkoxy, acylamino, aminocarbonyl, alkylaryl or aryl group;

$R_4$ and $R_5$ each represent an alkyl, aralkyl, aryl group or hydrogen atom; and $R_6$ represents a substituent similar to $R_2$ or $R_3$.

2. A heat transfer sheet according to claim 1, wherein the dye layer contains a binder and an ink flowability modifier.

3. A heat transfer sheet according to claim 1, wherein a primer layer with low dye dyeability is formed between the substrate sheet and the dye layer.

4. A heat transfer sheet according to claim 3, wherein said primer layer comprises an organic titanate with low dye dyeability.

5. A heat transfer sheet according to claim 3, wherein a second primer layer comprising a hydrophilic or water soluble resin having low dye dyeability is formed between the primer layer and the dye layer.

6. A heat transfer sheet according to claim 1, wherein a heat-resistant layer and/or a heat-resistant slip layer are/is formed on the surface on the side where no dye layer is formed on the substrate sheet.

7. A heat transfer sheet according to claim 6, wherein the heat-resistant slip layer contains (a) a reaction product of a thermoplastic resin containing hydroxyl group with an isocyanate, (b) a phosphoric acid ester type surfactant, and (c) a filler.

8. A heat transfer sheet according to claim 7, wherein the reaction product of said (a) comprises a product obtained by the reaction with an equivalent ratio of isocyanate groups/hydroxyl group in the range of from 0.8 to 2.5.

9. A heat transfer sheet according to claim 1, wherein the substrate sheet contains a lubricant.

10. A heat transfer method which comprises forming an image according to the heat-sensitive transfer system on an image-receiving sheet with the use of the heat transfer sheet of claim 1 and effecting transfer of the same image pattern at least twice in superposition on said image-receiving sheet.

* * * * *